US006155637A

United States Patent [19]

Waters

[11] Patent Number: 6,155,637

[45] Date of Patent: Dec. 5, 2000

[54] SLIPCOVER FOR GLIDER ROCKERS

[76] Inventor: Abby Waters, 4601 NW. 26th Ave., Boca Raton, Fla. 33434

[21] Appl. No.: 09/436,223

[22] Filed: Nov. 9, 1999

Related U.S. Application Data

[60] Provisional application No. 60/111,809, Dec. 11, 1998.

[51] Int. Cl.[7] ..... A47C 27/00

[52] U.S. Cl. ..... 297/225; 297/228.13; 297/228.12; 297/188.01

[58] Field of Search ..... 297/219.1, 225, 297/228.1, 228.12, 228.13, 229, 188.2, 188.01, 188.18, 423.41, 259.3, 258.1

[56] References Cited

U.S. PATENT DOCUMENTS

| | | |
|---|---|---|
| 1,738,557 | 12/1929 | Beiling . |
| 2,061,302 | 11/1936 | Egler . |
| 2,667,211 | 1/1954 | Krasnov et al. . |
| 2,937,695 | 5/1960 | Coggin . |
| 3,266,841 | 8/1966 | Altman . |
| 3,610,685 | 10/1971 | Lay . |
| 3,916,447 | 11/1975 | Thompson . |
| 4,553,785 | 11/1985 | Duke, Jr. et al. . |
| 4,725,094 | 2/1988 | Greer . |
| 4,877,288 | 10/1989 | Lee . |
| 4,892,353 | 1/1990 | Goddard . |
| 5,203,611 | 4/1993 | Greenwood . |
| 5,275,463 | 1/1994 | Rocha . |
| 5,326,152 | 7/1994 | Baron . |
| 5,427,433 | 6/1995 | Holobaugh, Jr. . |
| 5,620,229 | 4/1997 | Ledford . |
| 5,676,422 | 10/1997 | White et al. . |
| 5,690,380 | 11/1997 | Waters . |
| 5,802,643 | 9/1998 | Sloot . |
| 5,806,925 | 9/1998 | Hanley . |

FOREIGN PATENT DOCUMENTS

| | | |
|---|---|---|
| 1476777 | 4/1967 | France . |
| 1143275 | 2/1969 | United Kingdom . |

*Primary Examiner*—Milton Nelson, Jr.
*Attorney, Agent, or Firm*—Richard C. Litman

[57] ABSTRACT

A slipcover for glider rockers and/or other similar chairs, having an outer or upper layer of fabric material with a liner of moisture repellent material being either removably or permanently attached to the underside of the outer layer. The present slipcover may include a removably attachable pillow, with the pillowcase being removable from the pillow and comprising the same material as that used for the chair slipcover. A pocket drape may be removably secured to one arm of the cover, or about the arm of an open arm chair where the cover does not cover the open arm. The system for attaching the pocket drape to the cover is concealed when the pocket drape is not attached thereto, and is concealed by the overlying pocket drape when the pocket drape is secured in place. The present slipcover may be adapted for use with any suitable chair, but is particularly suited for use in covering a glider rocker type chair. Such chairs are often provided with an accompanying ottoman using the same glider rocker principle as the chair, and a matching slipcover for such an accompanying ottoman, may be included if desired.

16 Claims, 4 Drawing Sheets

SLIPCOVER FOR GLIDER ROCKERS

REFERENCE TO RELATED PATENT APPLICATION

This application claims the benefit of U.S. Provisional Patent application Ser. No. 60/111,809, filed on Dec. 11, 1998.

BACKGROUND OF THE INVENTION

1. Field of the Invention

The present invention relates generally to covers and protectors for various articles, and more specifically to a slipcover for an article of furniture known as a glider rocker. At least one embodiment of the present slipcover is specifically adapted for use with glider rockers, and may include a matching cover for a mating ottoman. The cover may include a permanently affixed or removable moisture repellent liner, removably attachable pillow and pocket, and other features.

2. Description of the Related Art

The glider rocker has become a popular article of furniture, particularly for new mothers who are nursing their infants. The smooth gliding action of such rockers is quite soothing, not only to the infant, but also to the mother as well. Such rockers are also commonly provided with mating or matching ottomans, which include the same gliding action.

However, such rockers and ottomans are not provided with any form of slipcover or other protection at the time of manufacture or sale. While they may include conventional upholstery fabric covers for the cushions of the rocker, no other protection for the cushions is provided. Moreover, the conventional upholstery material used to cover such conventional cushions, is not removable from the cushions. While treating such material with a moisture or stain repellent material may be accomplished, such moisture and stain repellents do not provide the protection that a complete, moistureproof overlying slipcover provides. Moreover, when one purchases such furniture, one is limited to the style, color, and/or pattern of the permanent upholstery fabric of the cushions provided with the furniture. If a person wishes to change the decor at a later date, he or she must purchase new cushions, as the upholstery fabric of such cushions is not removable.

Accordingly, a need will be seen for a slipcover for glider rockers, which may be removably installed over the structure and existing upholstery and cushions of an existing glider rocker. The slipcover may include a permanent or removable moisture barrier on the underside thereof, as well as at least one removably attachable storage pocket, at least one removably attachable pillow, and other features. A matching ottoman cover may also be provided. The slipcover may be adapted to other articles of furniture as well.

A discussion of the related art of which the present inventor is aware, and its differences and distinctions from the present invention, is provided below.

U.S. Pat. No. 3,266,841 issued on Aug. 16, 1966 to Gustave Altman, titled "Protective Cover Having Means For Releasibly Securing It To A Surface," describes the attachment of a relatively small cover to the underlying portion of a chair, by means of mating hook and loop fastening material (e.g., Velcro, tm) disposed on the underside of the cover and on the attachment area of the chair. Altman does not disclose a full cover for the chair, nor a matching cover for an accompanying ottoman, as provided by the present slipcover. Moreover, Altman does not provide any additional features, such as a moisture repellent lining, attachable pockets or pillows, etc., as provided by the present invention. Altman requires the article of furniture to which his cover is to be attached, to have some permanently installed mating attachment means. The present slipcover does not require any modification to the furniture to which it is installed.

U.S. Pat. No. 3,610,685 issued on Oct. 5, 1971 to Ralph B. Lay, titled "Backrest Pad," describes an upholstered pad with extension flaps having snap fasteners thereon, for securing about the horizontal members of a conventional chair (e.g., kitchen chair or the like). The device is not flexible, as is the present slipcover, due to the rigid panel enclosed within the assembly. Lay makes no provision for covering the entire chair, nor does he provide a matching cover for an accompanying ottoman or footrest, as provided by the present invention. Lay does not provide a fabric cover with moistureproof lining, as in the present invention, but instead uses a vinyl outer covering.

U.S. Pat. No. 3,916,447 issued on Nov. 4, 1975 to Lenore E. Thompson, titled "Low Cost, Absorbent, Clinging, Aqueous Liquid Barrier Protective Covering," describes a disposable sheet material having a clinging material on one side thereof and an opposite fibrous moistureproof barrier material. The material is inexpensive and disposable, unlike the relatively non-disposable, permanent cover of the present invention. Thompson does not disclose any means of forming the sheet to mate with the contours of an article of furniture, as provided by the present slipcover, nor does she disclose any other attachment means other than the clinging nature of the material. No removably attachable pockets or pillows are disclosed by Thompson, as provided by the present invention.

U.S. Pat. No. 4,553,785 issued on Nov. 19, 1985 to George B. Duke, Jr. et al., titled "Lounge Chair Cover," describes a cover formed of a terrycloth material and adapted to fit closely about the chair. No moisture repellent means is disclosed by Duke, Jr. et al. for their chair cover, and in fact the terrycloth material used is known for its moisture absorbent properties, rather than being moisture repellent. Duke, Jr. et al. provide a removable pillow, but the pillow is held in place by means of permanently installed straps at the head area of the cover, rather than using hook and loop fastening means, as in the present slipcover. Duke, Jr. et al. also provide pockets along the side of their cover, but the pockets are permanently installed, rather than being removable, as in the present invention.

U.S. Pat. No. 4,725,094 issued on Feb. 16, 1988 to Stephen I. Greer, titled "Expandable Terry Cloth Sand Or Lawn Chair Cover Having Integrally Formed Pockets," describes a cover having a removably installable pillow and pockets. However, the Greer pillow installs between the cover and underlying chair when used as a headrest, thus requiring the cover to be removed partially for installation of the pillow. Also, the Greer pockets are permanently installed, unlike the removable pocket arrangement of the present cover. Moreover, the Greer cover is formed of absorbent terrycloth material and no moisture barrier is disclosed, whereas the present cover incorporates a moisture repellent barrier beneath the outer cover material.

U.S. Pat. No. 4,877,288 issued on Oct. 31, 1989 to Susan Lee, titled "Lounge Chair Cover," describes a fabric cover similar to the Duke, Jr. et al. cover discussed further above. Lee describes her cover as being formed of fabric, and does not disclose any underlying moisture barrier, as provided in the present invention. Fabric is well known for absorbing moisture, and this is desirable in the lounge chair covers of Duke, Jr. et al., Greer, and Lee, where such chairs are commonly used near the water and an absorbent material is desired. Lee also provides concealed pockets, which may be desirable out of doors, but cannot be accessed readily from a seated position, as is desirable. The Lee pockets, as well as the pillow provided, are not removable from the remainder of the cover, as in the present slip cover invention.

U.S. Pat. No. 4,892,353 issued on Jan. 9, 1990 to Dan J. Goddard, titled "Cover For Lounge Chair," describes a moisture absorbent terrycloth cover similar to the Duke, Jr. et al. cover discussed further above. Goddard provides pockets at various locations in his cover, but none of the pockets are removable, as in the present slip cover invention. Goddard does not provide any pillow means, removable or otherwise, in his cover. As in the other terrycloth covers described above, the moisture absorbent nature of the terrycloth material teaches away from the moisture repellent barrier provided with the present cover. Also, as in the case of all the other covers of which the present inventor is aware, no accompanying cover is provided for an accompanying article of furniture, such as an ottoman, as provided by the present slipcover invention.

U.S. Pat. No. 5,203,611 issued on Apr. 20, 1993 to Mark H. Greenwood, titled "Infant Bounce And Rocking Chair," describes a cover for either end of a frame having opposite generally U-shaped portions. The cover includes an inherent pocket, but as in most of the other covers described further above, the pocket installs over the frame of the chair, and cannot be used for the storage of other articles therein. The inherent pocket is not removable from the cover, as in the case of the present cover with removable pocket. No pillow means, removable or otherwise, is disclosed by Greenwood. Also, Greenwood describes the cover as being formed of a fabric material, but he does not note any moisture repellent properties for his cover, as provided by the present slipcover invention.

U.S. Pat. No. 5,275,463 issued on Jan. 4, 1994 to Nicasio I. Rocha, titled "Cover For Lounge Chair," describes a terrycloth fabric cover having permanently installed side and head pocket areas, with the head pocket being usable as a pillow. None of the pockets or pillow means are detachable from the cover, as provided by the present invention. The moisture absorbent material of the Rocha cover is unlike the present cover, with its moisture repellent barrier. As in other prior art, Rocha does not disclose any additional cover means for an accompanying article of furniture, as provided by the present slip cover invention.

U.S. Pat. No. 5,326,152 issued on Jul. 5, 1994 to Richard K. Baron, titled "Folding Lawn Chair Cover," describes a cover formed of terrycloth, cotton, or polyester material. Baron does not disclose any moisture repellent means for his cover, as provided by the underlying moistureproof barrier of the present cover. Also, while Baron describes a pocket and pillow with his cover, the pocket is on the back of the backrest portion, where it is inaccessible by a seated person. Neither the pocket nor the pillow of the Baron cover is removably installable, as in the case of the pocket and pillow of the present slipcover invention. As in the case of the other prior art covers described herein, Baron does not provide any additional cover means for an accompanying ottoman or footrest, as provided by the present slipcover invention.

U.S. Pat. No. 5,620,229 issued on Apr. 15, 1997 to Janet K. Ledford, titled "Combination Carrying Bag, Cover And Accessory Storage For A Portable Folding Lounge," describes a cover including a permanently installed pocket or pockets along one edge thereof. The pockets are not removable, nor does Ledford disclose any form of pillow, either permanently installed or detachable, for his cover. Ledford describes the material used as being water repellent, and describes the coating of any fabrics which would otherwise not be water repellent. The present invention utilizes a separate moisture repellent barrier sheet beneath the fabric cover, unlike Ledford. Again, no additional cover for an accompanying article of furniture is provided by Ledford, as is provided by the present invention.

U.S. Pat. No. 5,690,380 issued to Abby Waters on Nov. 25, 1997, titled "Slipcovers With Interchangeable Trim," describes slipcovers for conventional chairs, with the covers including means for exchanging various trim articles which may be removably attached to various areas thereof. No external storage pockets for the storage of various articles therein are provided, nor is any permanently or removably installed pillow provided in this patent previously issued to the present inventor. No mention is made of any moisture repellent properties, either of the cover itself, or of any underlying sheet permanently or removably secured to the overlying cover, as provided by the present invention. No separate cover for covering an associated article of furniture, such as an ottoman or footrest, is disclosed in the '380 U.S. Patent.

U.S. Pat. No. 5,802,643 issued on Sep. 8, 1998 to Alexander Sloot, titled "Slipcover With An Inflatable Pillow," describes a partial cover for placement over the headrest of a lounge chair. The cover comprises a pocket for placement over the back of the chair, with one side of the cover forming a headrest portion and the opposite side serving as the retaining member across the back of the chair. The cover is formed of an air and water tight layer with a fabric exterior layer thereover. The air and watertight layer is doubled in the area of the pillow to provide for inflation. This construction results in a permanently and immovably installed pillow, unlike the removable pillow of the present slip cover invention. Moreover, Sloot does not provide a storage pocket, either permanently installed or removable, for various accessories for a person seated in a chair using his cover.

French Patent Publication No. 1,476,777 published on Mar. 6, 1967 to Florimond Baert illustrates an armchair having an integral pocket formed to the outside of the right arm thereof. No slipcover is apparent in the French Patent Publication.

Finally, British Patent Publication No. 1,143,275 published on Feb. 19, 1969 to Customagic Manufacturing Co., Ltd., describes a slipcover formed of a knitted fabric material for covering an open arm type chair. The material used is described as a knitted fabric, not known for water repellent properties. No pockets or pillows are disclosed in the British Patent Publication.

None of the above inventions and patents, either singly or in combination, is seen to describe the instant invention as claimed.

SUMMARY OF THE INVENTION

The present invention comprises a slipcover adapted particularly for glider rockers, for protecting the underlying fabric material of the cushions generally provided with such rockers. The present slipcover is formed of a fabric upper layer with a moisture repellent liner being permanently bonded or removably attached to the underside of the upper layer of material. One or more removably attachable pillows may be provided with the cover, for use as desired. The pillow(s) are preferably covered with a removable cover or case of the same type of fabric material used for the chair cover. A removable "saddle bag" arrangement may also be provided, with the device including one or more pockets thereon. The pocket device is removably attachable to the arm portion of the cover, by a concealed attachment means. The present cover may include an accompanying matching cover for an ottoman or foot rest which accompanies the chair, if so desired. While the present slipcover invention is directed particularly for use with a glider rocker type of chair, it may also be applied to other types of chairs as well.

Accordingly, it is a principal object of the invention to provide an improved slipcover for glider rocker chairs and the like, with the slipcover comprising an outer fabric layer and a moisture repellent liner material, either permanently bonded or removably attached to the underside of the outer fabric material.

It is another object of the invention to provide an improved slipcover including a pillow removably attachable thereto, with the pillow including a removable fabric case of the same material as that used for the slipcover.

It is a further object of the invention to provide an improved slipcover including pocket means removably attachable thereto, with the pocket means being in the form of a drape removably installable over one arm of the slipcover.

An additional object of the invention is to provide an improved slipcover which pocket attachment means is concealed when not in use.

Still another object of the invention is to provide an improved slipcover which may include an accompanying cover for an ottoman or footrest accompanying the chair to which the present cover is applied.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
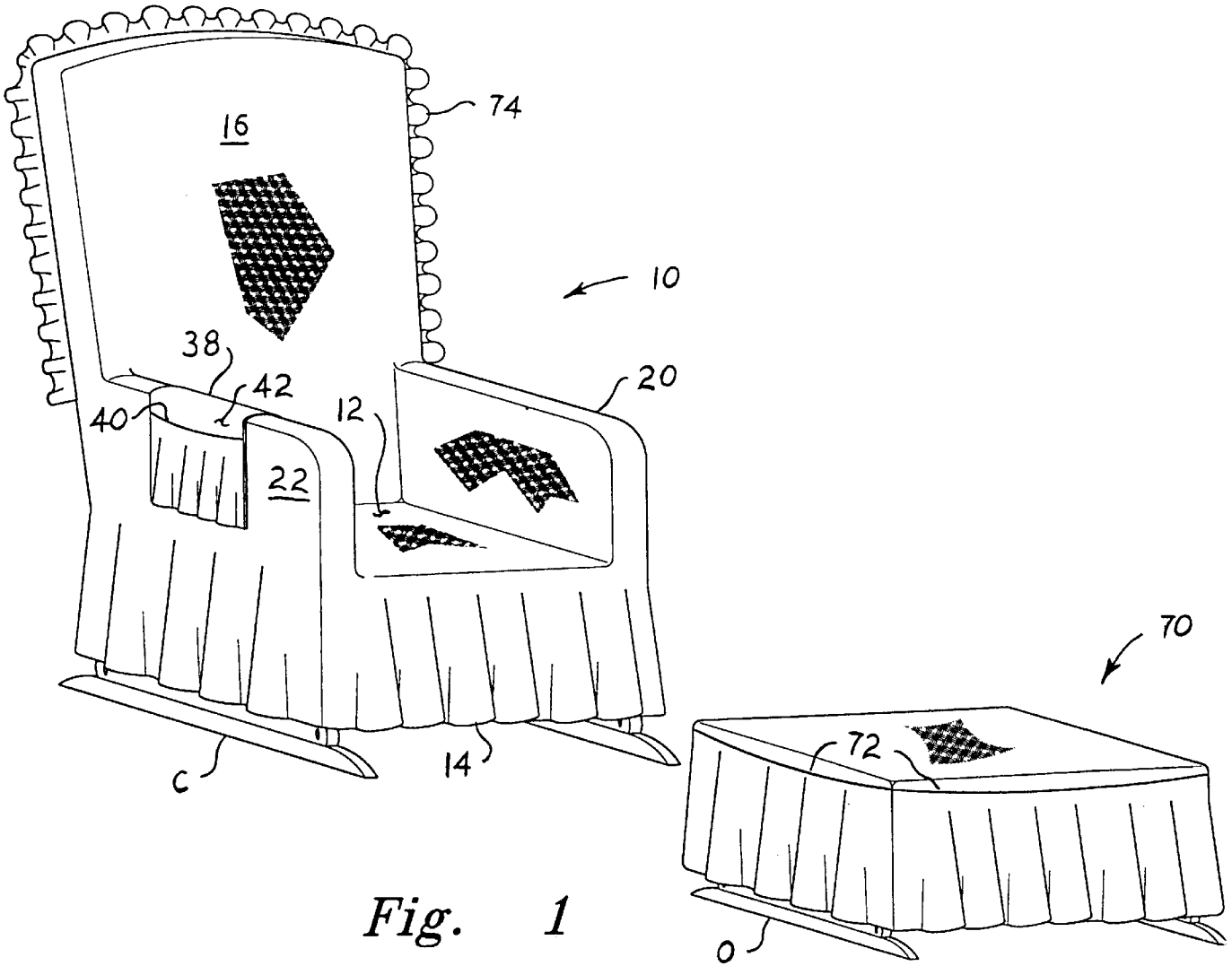
FIG. 1 is an environmental perspective view of the present slipcover and accompanying ottoman cover, installed upon a glider rocker type chair and accompanying glider rocker ottoman.

The present invention comprises a slipcover for an article of furniture, such as a glider rocker or the like, with the slipcover having a general configuration substantially as shown in FIG. 1. The slipcover 10 includes at least a seat cover portion 12, a forward drape portion 14, a forward chair back cover portion 16, and a rearward chair back cover portion 18 (shown in FIG. 2). The forward drape portion 14 and rearward chair back cover portion 18 each extend downwardly to a point near the floor or underlying surface, to cover essentially the entire article of furniture when installed thereon. The present slipcover 10 is particularly well adapted for the protective covering of glider rocker chairs having left and opposite right arms, as in the chair C of FIG. 1, with the cover 10 of FIG. 1 also including a left arm cover 20 and opposite right arm cover 22, to provide complete protection for the entire chair C.

While slipcovers for articles of furniture have been developed in the past, none has been particularly adapted for and suited for removable installation upon a glider rocker, whereas the present slipcover 10 is particularly well suited for such installation. (However, it will be seen that the present slipcover 10 may be adapted for use in covering and protecting other types of furniture as well.) Moreover, conventional slipcovers have not provided the protection from liquid spills and the like, which the present slipcover 10 provides.

Figure 2:
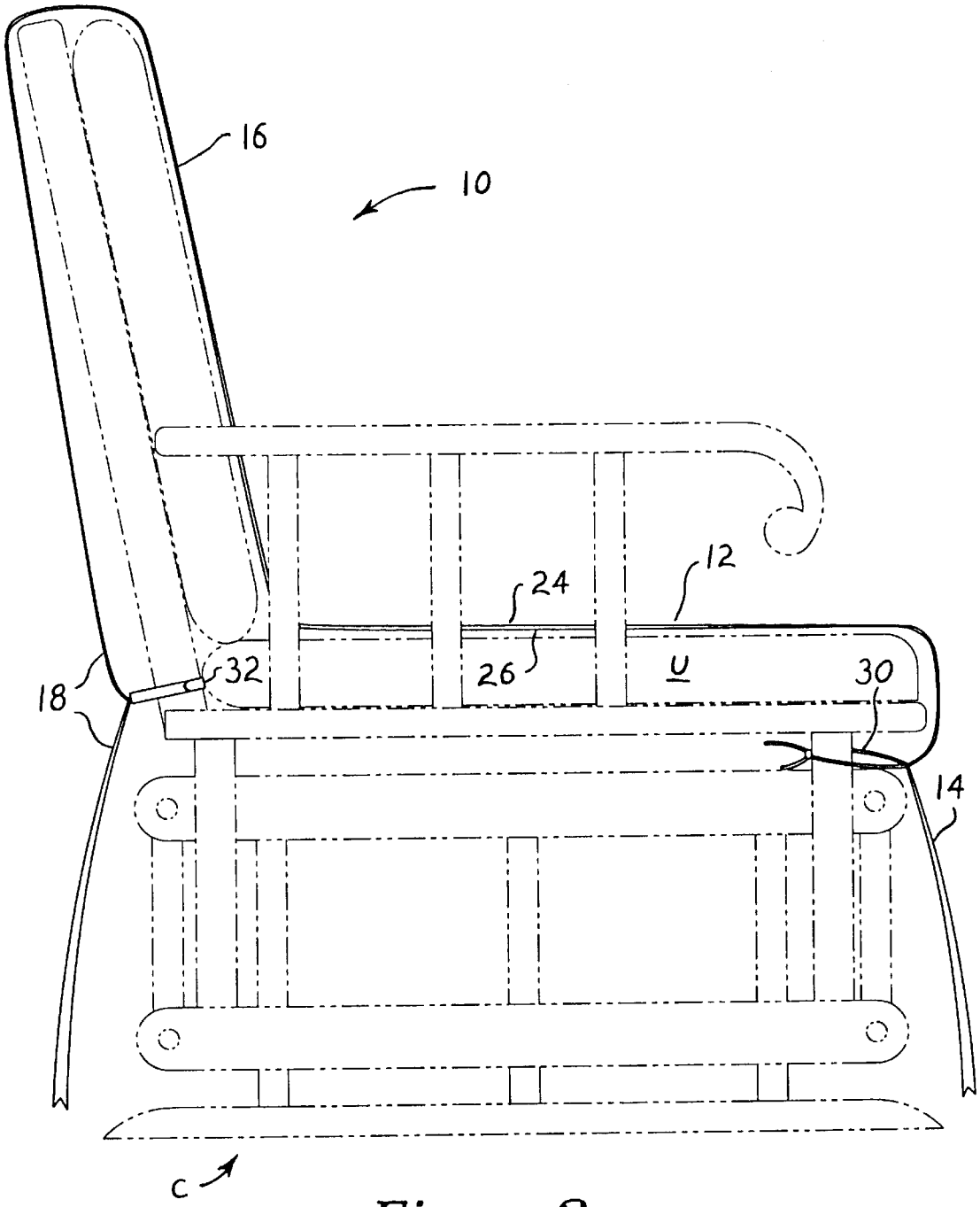
FIG. 2 is a right side elevation view in section of the present slipcover, with the glider rocker chair to which it is secured being shown in broken lines, showing the means used for securing the present cover to the chair structure.

FIG. 2 provides a cross sectional view of the present slipcover 10 removably secured in place on a glider rocker chair C. It will be seen that the slipcover 10 is formed of two layers or sheets of material, with an outer or uppermost sheet 24 of woven fabric material in order to provide an attractive and traditional appearance. However, the slipcover 10 also includes an underlying layer or sheet 26, comprising a liquid repellent material to provide a liquid barrier for any spills which may occur on the slipcover 10, to preclude their penetration to the underlying upholstery U of the chair C.

Figure 4:
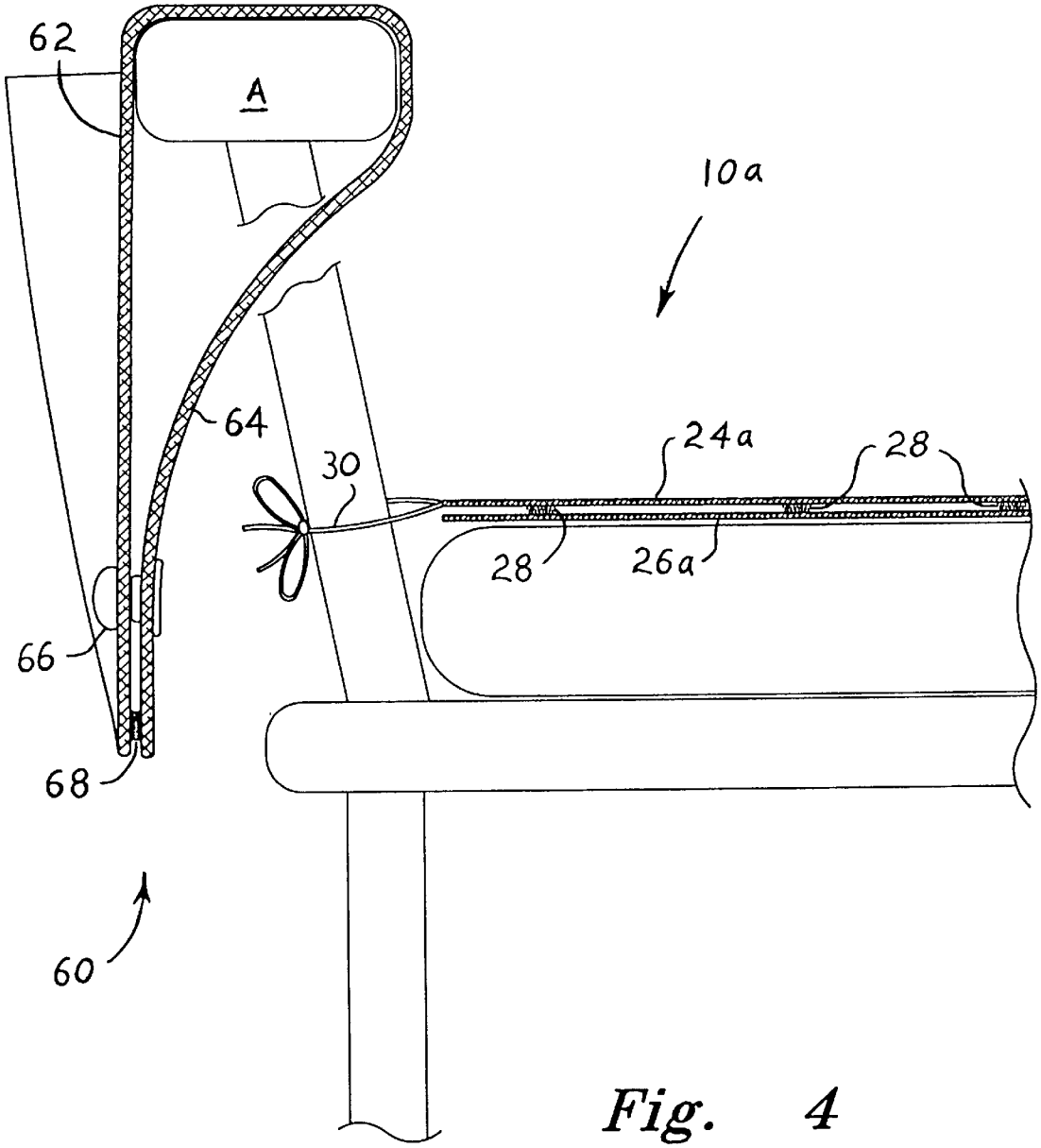
FIG. 4 is a right side elevation view in section of the right arm portion of the chair, showing alternative means for securing the pocket attachment means about the uncovered arm of an open arm chair.

In the case of the slipcover 10 of FIG. 2, the two layers or sheets 24 and 26 are permanently secured to one another (e.g. bonded, heat sealed, etc.), and may not be separated from one another. However, it may be desirable to provide for the separation of the two layers. Accordingly, the slipcover 10*a* of FIG. 4 is formed of a single upper or outer sheet 24*a* of woven fabric material, and a separate underlying layer or sheet 26*a* which is removably attachable to the overlying sheet 24*a* by some means, e.g., mating hook and loop fastening material 28 installed to the facing surfaces of each sheet 24*a* and 26*a*, at a plurality of mating contact points therebetween. Different means (not shown) for removably securing the two sheets 24*a* and 26*a* together may be used (e.g., snaps, buttons, etc.), if so desired.

Figure 3:
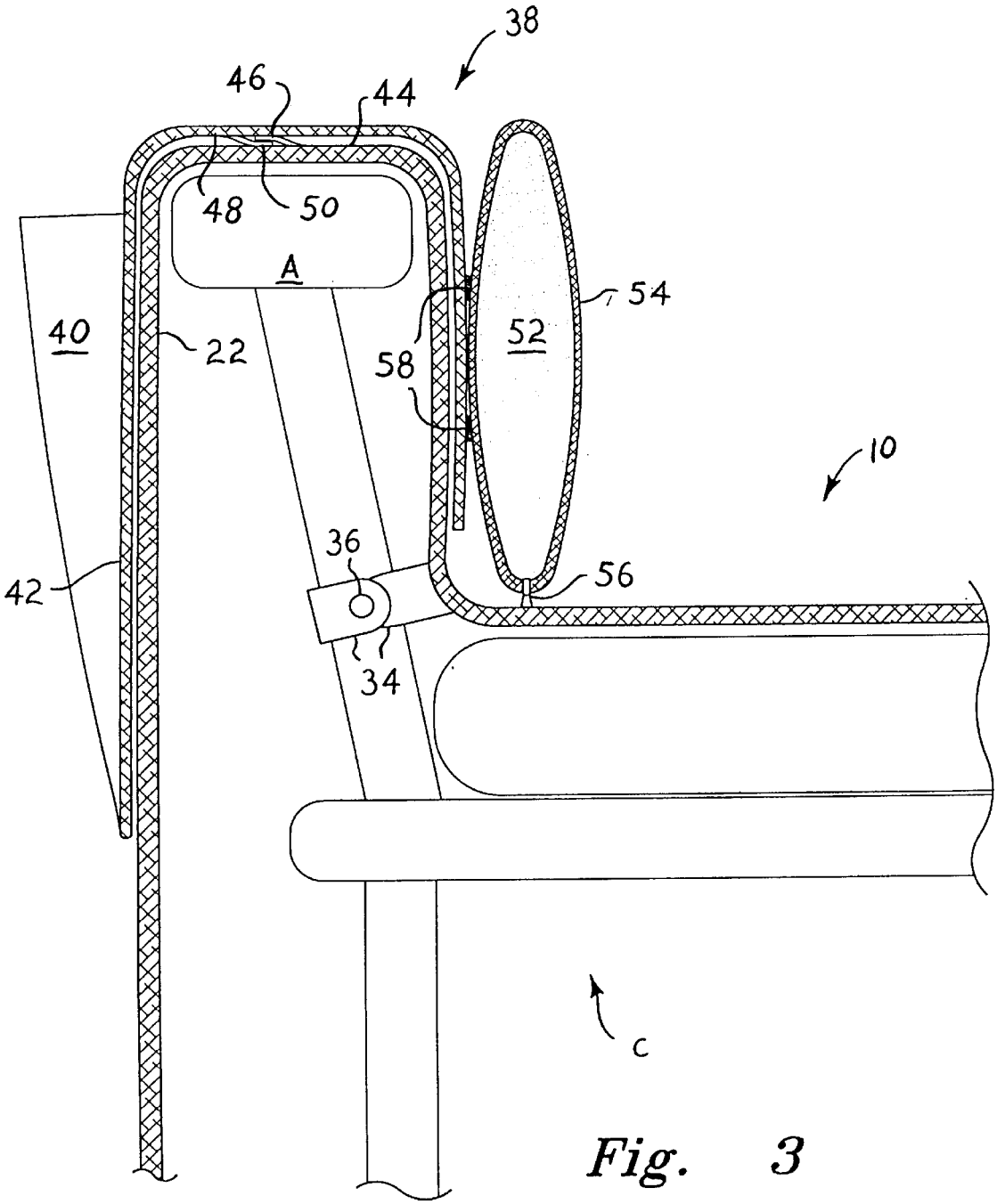
FIG. 3 is a front elevation view in section of the right arm structure of the chair and cover portion therefor, showing the concealed attachment means for securing the pocket means to the arm portion of the cover and the removable attachment means for the accompanying pillow.

FIGS. 2, 3, and 4 illustrate various attachment means which may be used to secure the present cover 10 or 10*a* to the underlying glider rocker chair C, or other chair. FIGS. 2 and 4 illustrate the use of ties 30 extending inwardly from the inner liner 26 or outwardly from the outer liner 24*a* at various optimized points, to tie about the structure of the chair C. FIG. 2 also discloses the use of straps 32 having mating hook and loop fastener material (not shown, but essentially identical to the fastener material 28 shown in FIG. 4 for holding the two sheets 24*a* and 26*a* together). In FIG. 3, straps 34 with snap fasteners 36 are used to secure the cover about the arm structure of the chair C. It will be seen that any combination of the above removable attachment means, and/or other means (buttons, etc.) may be used to removably secure any portion of the present slipcovers 10 and/or 10*a* to an underlying chair C or other article of furniture, as desired.

FIG. 3 provides a detailed cross sectional view of the right arm cover 22 of the slipcover 10 positioned over the right arm A of the chair C, with an overlying drape and pocket assembly 38 secured to the arm cover 22. (The plural layers of material comprising the cover 10 are not shown in FIG. 3, for clarity in the drawing Figure, particularly around the arm cover 22 and drape and pocket assembly 38.) The drape and pocket assembly 38 includes one or more pockets or pouches 40 disposed to the outer panel 42 thereof, for holding articles which might be used for the care of an infant (bottles, etc.), or for holding other articles, as desired. The drape and pocket assembly 38 may also include a moisture proof liner (not shown, for clarity in the drawing Figure), in the manner of the slipcover 24 or 24*a* and liner 26 or 26*a*, discussed further above.

The drape and pocket assembly 38 is removably secured to the arm cover portion 22 of the slip cover 10, by a novel overlapping and concealed attachment means, shown in detail in FIG. 3 of the drawings. The upper surface 44 of the arm cover portion 22 of the slipcover 10 includes a flap of material 46 thereon, with the underside 48 of the overlying pocket drape assembly 38 having a similar flap of material 50 thereon. These two flaps of material 46 and 48 include mating attachment means (e.g., hook and loop fastening material, or other suitable mating attachment means, as desired), which engage one another to secure the two flaps 46 and 50 together, thus securing the drape and pocket assembly 38 to the arm portion 22 of the slipcover 10. (The mating attachment means of the two flaps 46 and 50 are not shown in FIG. 3, for clarity in the drawing Figure, but may comprise substantially the same fastening means as the attachment means 28 shown in FIG. 4 for securing the removable liner sheet 26*a* to the underside of the slipcover sheet 24*a*.)

The two flaps 46 and 50 each have their respective attachment means disposed to their respective undersurfaces, i.e., those surfaces which are concealed and which lie against the respective surfaces 44 and 48 of the arm cover portion 22 and pocket and drape assembly 38, when the pocket and drape assembly 38 is removed from the arm cover portion 22 of the slipcover 10. In this manner, the relatively rough hook or loop material preferably used as the attachment means, is not exposed to contact by a person seated in the chair C, when the pocket and drape assembly 38 is removed However, when attachment of the pocket and drape assembly 38 to the arm portion 22 of the slipcover 10 is desired, the pocket and drape assembly 38 may be folded back for access to the flap 50 on its undersurface 48, and the two flaps 46 and 50 opened or lifted toward one another. The mating attachment means of the two flaps 46 and 50 are then applied to one another, to attach the pocket and drape assembly 38 to the arm portion 22 of the slipcover 10. The result is an unobtrusive attachment, as shown in FIG. 3. The attachment flap 46 of the arm cover portion 22 of the slipcover 10 also serves to conceal the attachment means when the drape and pocket assembly 38 is removed, and thus continues to provide an unobtrusive and relatively smooth surface which remains comfortable to a person seated in the chair C.

The present slipcover 10 may also include a removably attachable pillow 52 therefor, if so desired, as shown in FIG. 3 of the drawings. The pillow 52 preferably includes a pillowcase 54 constructed in the manner of the slipcover 10, having an outer woven fabric layer and an inner moistureproof layer, with the two layers being either removably or permanently attached to one another, in the manner of the layers or sheets 24 and 26 or 24*a* and 26*a* of FIGS. 2 and 4 of the drawings. The pillowcase or cover 54 may be removable from the pillow 52, as by a zipper 56 or other suitable closure means. Removable attachment means, such as the mating hook and loop fastener material 58, may be used to secure the pillow 52 in place temporarily as desired. Such attachment means 58 may be concealed, in the manner of the flaps 46 and 50 for securing the pocket and drape assembly 38 to the arm portion 22 of the slipcover 10, if so desired. Also, while the pillow 52 is shown secured to the inner panel 58 of the arm cover portion 22 of the slipcover 10, it will be seen that the attachment means 58 may be provided in virtually any location desired on the slipcover 10.

FIG. 4 discloses an alternative means of providing a pocket and drape assembly, where no contiguous chair arm cover is provided for the slipcover. In FIG. 4, the pocket and drape assembly 60 stands alone from the separate slipcover assembly, comprising the upper woven fabric cover sheet 24*a* and the lower moistureproof liner 26*a*, removably attached thereto. The pocket and drape assembly 60 includes an outer drape portion 62 and an opposite inner drape portion 64, which secure removably to one another below the arm A of the chair, e.g., by mating snap means 66, as shown. It will be seen that alternative attachment means (e.g., hook and loop fastener 68, etc.) may be used to secure the two drape portions 62 and 64 of the pocket and drape assembly 60 to one another, if so desired.

Returning to FIG. 1, it will be noted that most glider rocker type chairs are accompanied by an ottoman which incorporates essentially the same gliding and rocking mechanism as that used by the chair C, but on a smaller scale. Accordingly, the present invention may include an accompanying slipcover 70 for such an accompanying ottoman O, as shown in FIG. 1.

The ottoman slipcover 70 is configured to fit reasonably closely about a conventional glider rocker ottoman O. It will be seen that the ottoman cover 70 may be used as a removable slipcover for other low furniture articles as well, such as fixed ottomans or footrests, etc. The ottoman slipcover 70 is preferably formed of a woven fabric which matches or complements the fabric used for the slipcover 10 of the accompanying chair C, although other fabrics may be used. Preferably, the ottoman slipcover 70 also includes a moistureproof inner liner or sheet, either permanently bonded to the outer fabric sheet or removably attached thereto, as in the construction of the slipcover embodiments of the present invention. The ottoman slipcover 70 may include one or more peripheral pockets 72 formed therein, if desired. Such pockets 72 are most useful for the temporary storage of various small articles (children's toys, etc.) which might otherwise be left on the floor.

In summary, the present slipcover embodiments for glider rockers or other articles of furniture, provides a much needed means of protecting the permanent fabric cushions of such furniture from liquid spills, stains, etc. which commonly occur in normal day-to-day use. As glider rockers, and their accompanying ottomans, are quite popular with mothers who are nursing and/or caring for very young infants, the present slipcover invention will be welcomed by such women as a means of providing protection for the relatively expensive glider rocker, or other, furniture.

Typically, such glider rockers are not provided with removable slipcovers, and the only means of protecting the upholstery of such furniture is by means of a generic slipcover which is not suitable for such furnishings. In any event, such prior art slipcovers are not provided with a moistureproof barrier, and allow moisture to penetrate the slipcover and stain the underlying permanent upholstery fabric of the rocker. The only solution to such a stain is to replace the damaged cushion, which is obviously quite costly. Such cushions must be ordered on a custom basis, resulting in a considerable time delay and expense. Moreover, such cushions as are provided with the furniture, are not particularly elegant or suited for a nursery or similar area.

The present slipcovers (as well as accessories therefor, such as the pillowcase 54, drape and pocket assembly 38 and/or 60, and ottoman cover 70) may be formed of more suitable fabrics and materials, and may include additional decorative features, such as a ruffle trim 74 (shown in FIG. 1) or other decorative features, as desired. The present slipcover provides a relatively inexpensive and quick solution for damaged or stained cushions; prevents damage to upholstery over which it is used, by means of the moisture-proof liner; provides for decorative options (e.g., particularly directed to a boy's or girl's nursery, etc.); and does not require expensive custom fitting. Thus, the present slipcover invention will prove to be popular with many persons who have purchased a glider rocker and accompanying ottoman, or other similar article of furniture.

It is to be understood that the present invention is not limited to the embodiments described above, but encompasses any and all embodiments within the scope of the following claims.

I claim:

1. A removable protective cover for an article of furniture, comprising:

a slipcover having at least a seat cover portion, a forward drape portion, a forward chair back cover portion, and a rearward chair back cover portion, said slipcover covering essentially the entire article of furniture when installed thereon;

said slipcover including means for removably attaching to the article of furniture;

said slipcover comprising an outer sheet of woven fabric material and a liner sheet of moisture impervious material; and a separate ottoman slipcover having at least one pocket disposed thereon.

2. The removable protective cover according to claim 1 including at least one arm drape and pocket having means for removably attaching to an arm of a chair.

3. The removable protective cover according to claim 1, wherein said slipcover includes a pair of arm covers extending therefrom with at least one of said arm covers including an arm drape and pocket removably attachable thereto.

4. The removable protective cover according to claim 3, wherein said at least one of said arm covers and said arm drape and pocket each include cooperating concealed attachment means.

5. The removable protective cover according to claim 1 including means for attaching said slipcover to the article of furniture, with said means selected from the group consisting of ties, cooperating snap fasteners, and cooperating hook and loop material.

6. A removable protective cover for an article of furniture, comprising:

a slipcover having at least a seat cover portion, a forward drape portion, a forward chair back cover portion, and a rearward chair back cover portion, said slipcover covering essentially the entire article of furniture when installed thereon;

said slipcover including means for removably attaching to the article of furniture;

pocket means and pillow means removably secured thereto; and a separate ottoman slipcover having at least one pocket disposed thereon.

7. The removable protective cover according to claim 6 including means for attaching said slipcover to the article of furniture, with said means selected from the group consisting of ties, cooperating snap fasteners, and cooperating hook and loop material.

8. The removable protective cover according to claim 6 including at least one arm drape having said pocket means disposed thereon.

9. The removable protective cover according to claim 6, wherein said slipcover includes a pair of arm covers extending therefrom with at least one of said arm covers including an arm drape having said pocket means disposed thereon.

10. The removable protective cover according to claim 9, wherein said at least one of said arm covers and said arm drape and pocket means each include cooperating concealed attachment means.

11. An article of furniture and a removable protective cover therefor, comprising in combination:

a chair having at least a seat portion, a back portion, and a left and opposite right arm portion;

a slipcover having at least a seat cover portion, a forward drape portion, a forward chair back cover portion, a rearward chair back cover portion, said slipcover covering essentially the entirety of said chair when installed thereon;

said slipcover including means for removably attaching to said chair; and a separate ottoman slipcover having at least one pocket disposed thereon.

12. The article of furniture and removable protective cover combination according to claim 11 wherein said slipcover includes a pair of arm covers extending therefrom with at least one of said arm covers including an arm drape and pocket removably attachable thereto.

13. The article of furniture and removable protective cover combination according to claim 12 wherein said at least one of said arm covers and said arm drape and pocket each include cooperating concealed attachment means.

14. The article of furniture and removable protective cover combination according to claim 11, wherein said chair comprises a glider rocker.

15. The article of furniture and removable protective cover combination according to claim 11 wherein said slipcover includes at least one arm drape and pocket having means for removably attaching to a corresponding said arm portion of said chair.

16. The article of furniture and removable protective cover combination according to claim 11, including means for attaching said slipcover to said chair, with said means selected from the group consisting of ties, cooperating snap fasteners, and cooperating hook and loop material.

* * * * *